US009010963B2

(12) United States Patent
Mallory et al.

(10) Patent No.: US 9,010,963 B2
(45) Date of Patent: Apr. 21, 2015

(54) LENS MEMBER FOR DIRECTING LIGHT IN A SQUARE PATTERN

(71) Applicant: CoreLED Systems, LLC, Livonia, MI (US)

(72) Inventors: Derek S. Mallory, Plymouth, MI (US); Brian C. Wells, Grosse Pointe Farms, MI (US)

(73) Assignee: CoreLED Systems, LLC, Livonia, MI (US)

( * ) Notice: Subject to any disclaimer, the term of this patent is extended or adjusted under 35 U.S.C. 154(b) by 43 days.

(21) Appl. No.: 13/893,412

(22) Filed: May 14, 2013

(65) Prior Publication Data

US 2014/0340898 A1 Nov. 20, 2014

(51) Int. Cl.
*F21V 5/04* (2006.01)
*F21K 99/00* (2010.01)

(52) U.S. Cl.
CPC .... *F21K 9/50* (2013.01); *F21V 5/04* (2013.01)

(58) Field of Classification Search
CPC ..... F21V 5/04
USPC ..... 362/237
See application file for complete search history.

(56) References Cited

U.S. PATENT DOCUMENTS

2007/0253188 A1* 11/2007 Klipstein et al. ..... 362/105
2013/0042510 A1* 2/2013 Nall et al. ..... 40/541

* cited by examiner

*Primary Examiner* — Mary Ellen Bowman
(74) *Attorney, Agent, or Firm* — Butzel Long

(57) ABSTRACT

A lens member for projecting light from an LED in a square pattern includes a body formed of a light transmissive material. The body includes a base portion and a bulbous-shaped, light-directing lens portion extending upwardly from the base portion. A recess extending upwardly from a lower surface of the base portion and into the bulbous-shaped, light-directing lens portion continuously tapers from the base to a flat, circular surface below a top surface of the bulbous-shaped, light-directing lens portion. The lens portion has a horizontal cross-sectional shape that is substantially square at elevations between the base and the top surface of the lens portion.

15 Claims, 2 Drawing Sheets

LENS MEMBER FOR DIRECTING LIGHT IN A SQUARE PATTERN

CROSS-REFERENCE TO RELATED APPLICATIONS

Not applicable.

FIELD OF THE DISCLOSURE

This disclosure relates to lens members for LED lighting fixtures.

BACKGROUND OF THE DISCLOSURE

The development of high-intensity LED bulbs and their improved energy efficiency per unit of illumination intensity has led to the development of LED fixtures for street lighting, parking lot lighting, interior lighting and other applications in which conventional sodium vapor, mercury vapor, fluorescent or incandescent lights were and still are being used. A problem with LED fixtures arises from the fact that a plurality of LED bulbs is required to provide illumination equivalent to a single mercury vapor, sodium vapor or incandescent bulb. LED bulbs and lens members for LED bulbs generally divert the light from the LED into a circular pattern. In order to illuminate a large area with LEDs, it is generally necessary to use a light fixture on which a plurality of LEDs are arranged in an array with corresponding lens members that direct the light from the LEDs into overlapping circular beams. Due to the high amount of overlapping area needed to cover an area that is to be illuminated with light beams projecting a circular pattern, use of LED fixtures has resulted in non-uniform illumination, including a patterned distribution of bright, over-illuminated areas and relatively darker, less illuminated areas. Additionally, although LEDs are energy efficient, the number of LEDs needed to provide a desired level of illumination to a given area from a lighting fixture can be reduced if the overlapping areas can be reduced or eliminated. This would reduce both the cost of manufacturing the fixture and the energy cost of operating the fixture.

SUMMARY OF THE DISCLOSURE

Described herein is a lens member for directing light from an LED, which includes a body having a base portion and a bulbous, light directing lens portion projecting upwardly from the base portion. Defined within the body is a hollow recess extending upwardly from a bottom surface of the base portion. The recess tapers from a location adjacent the bottom of the base to a flat area centered below a top surface of the bulbous, light directing lens portion. The hollow recess at any elevation between the lower generally planar surface of the base portion and the flat area at the top of the hollow recess has a substantially circular horizontal cross-sectional shape. The bulbous, light-directing lens portion at generally any elevation between the base portion and a flat top surface of the bulbous, light-directing lens has a substantially square horizontal cross-sectional shape. The bulbous, light-directing lens portion continuously tapers from the base portion to the relatively flat top surface of the bulbous, light-directing lens portion.

The combination of a recess having substantially circular cross-sections and a bulbous, light-directing lens portion having substantially square cross-sections allows the lens member to be configured to project a substantially square illumination pattern on a surface to be illuminated which is located a predetermined spaced distance from the lens member. The substantially square illumination pattern allows a plurality of lens members and underlying LEDs to be arranged in an array in which the substantially square illumination patterns can be arranged in rows and columns in edge-to-edge relationship, with very little overlap, whereby perceptible variations in illumination intensity over a surface to be illuminated by a fixture comprising a plurality of LED can be eliminated or at least substantially reduced.

In certain embodiments, the recess is defined by a plurality of adjacent curved facets, each facet having a horizontal lower edge and two side edges that converge at the top of the recess.

In certain embodiments, the hollow recess extends upwardly from a bottom of the base portion beyond an upper surface of the base portion and partially into the bulbous, light directing lens portion.

DETAILED DESCRIPTION

Figure 1:
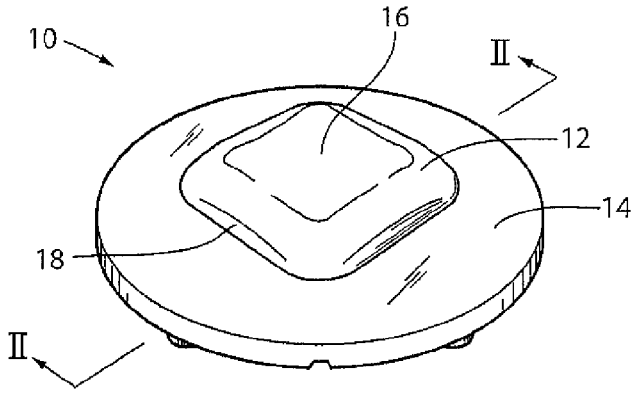
FIG. 1 is a perspective view of a lens body of this disclosure.
Figure 2:
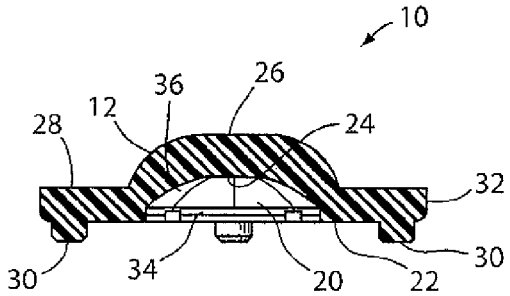
FIG. 2 is a vertical cross-sectional view of the lens body shown in FIG. 1.

The terms "top", "bottom", "lower", "upper" and similar terms relating to orientation are made with reference to the orientation shown in FIGS. 1 and 2 without regard to the actual orientation in which the illustrates lenses are used.

Shown in FIG. 1 is a perspective view of an LED lens body 10 having a generally square or rectangular upwardly protruding bulbous-shaped optic or lens portion 12 centrally located on the lens 10 and surrounded by a base or rim portion 14. The term "generally square" means that the protruding bulbous-shaped optic or lens portion 12 of lens body 10 as seen in a top view (FIG. 4) has a horizontal cross sectional shape at any elevation between the relatively flat upper surface 16 of rim portion 14 and the generally or substantively flat top surface 26 of the protruding optic portion 12 that is more nearly square than circular and more nearly square than any other regular polygonal shape.

As seen in the cross-sectional view of FIG. 2, lens 10 has a single hollow volume or recess 20 extending upwardly from a lower generally planar surface 22 of the disc-shaped base portion 14. The single hollow volume as or recess 20 as illustrated can extend upwardly into the bulbous-shaped portion 12. Recess 20 can continuously taper from an elevation at or near the bottom 22 of base portion 14 to a single flat, circular surface 24 that can be centered below the top surface 26 of the bulbous-shaped, light-directing lens portion 12.

Figure 3:
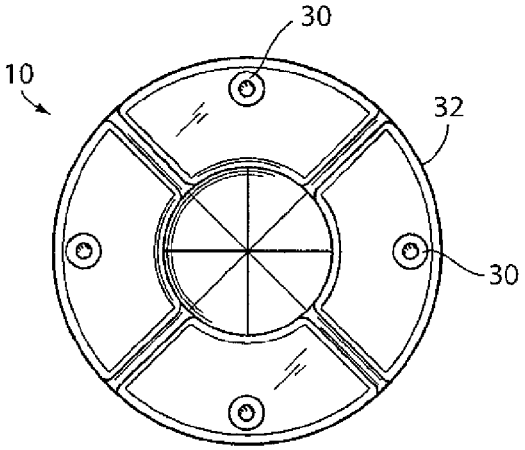
FIG. 3 is a bottom view of the lens body shown in FIG. 1.

The disc-shaped base portion 14 can have generally planar, parallel upper 28 and lower 22 surfaces. Projecting downwardly from otherwise planar bottom or lower surface 22 are pins or nubs 30 (FIGS. 2 and 3) disposed adjacent an edge 32 of base or rim portion 14. In the illustrated embodiment, there are four nubs 30 that are angularly displaced apart from each other adjacent an edge 32 by 90 degrees. However, any number of nubs may be employed, and may be disposed as desired. Nubs 30 may be used for positioning and mounting lenses 10 on a substrate, such as a circuit board.

At any elevation between the lower generally planar surface 22 of the disc-shaped base 14 and the flat, circular surface 24 of the recess 20, the recess has a substantially circular horizontal cross-sectional shape. Flat, circular surface 24 of recess 20 is parallel with the generally planar surface 22 of base 14. The recess 20 can be comprised of a generally cylindrical section 34 extending upwardly from lower surface 22, and disposed above the cylindrical section, an inverted bowl-shaped section 36, which may also be described as a spherical segment or truncated spherical cap (i.e., a section of a sphere defined between two parallel planes).

Figure 4:
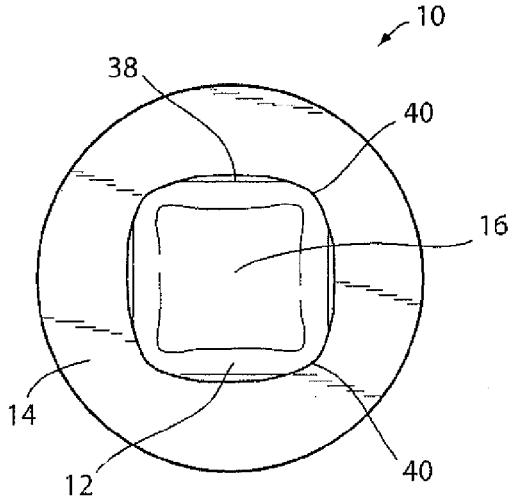
FIG. 4 is a top view of the lens body shown in FIG. 1.

The bulbous-shaped, light-directing lens portion 12 has a substantially square horizontal cross-sectional shape at generally any elevation between the upper surface 28 of base portion 14 and the top 26 of the lens portion. In particular, the generally square horizontal cross-sectional shape 38 can be a square shape having rounded corners 40 (FIG. 4). As can be seen in FIG. 2, the lens portion 12 continuously tapers from upper surface 28 of base portion 14 to the top 26 of the lens portion.

The various features of lens body 10, and particularly lens portion 12 and recess 20 allow light emitted from a source, such as a light-emitting diode (LED), positioned adjacent recess 20 to be projected or radiated from lens portion 12 in a substantially square pattern. This allows a plurality of LEDs and corresponding lens bodies 10 to be configured into an array so that each lens portion 12 projects a square pattern of light on a target substrate (e.g., a street, parking lot, building floor, etc.), with the projected square pattern from each lens being arranged in edge to edge relationship with little or no perceptible overlaps or gaps to eliminate dark spots and bright spots on a composite illumination pattern comprised of individually projected patterns from the individual lenses and LEDs. This provides efficient, inexpensive uniform illumination that is both functionally and aesthetically desirable.

Typically, the lens is fabricated from a polymer material defining a refractive index greater than air (e.g., a refractive index of at least about 1.2, 1.3, or 1.4 and/or up to about 1.5, 1.6, or 1.7). In a particular embodiment, the refractive index is about 1.49.

Applying total internal reflection (TIR), the lens can be shaped and sized to concentrate and focus the light to a desired or predetermined light pattern. TIR is an optical phenomenon that occurs when a ray of light strikes a medium boundary at an angle larger than the critical angle with respect to the normal to the surface. If the refractive index is lower on the other side of the boundary, no light can pass through and all of the light is reflected. The critical angle is the angle of incidence above which the total internal reflection occurs.

When light crosses a boundary between materials with different refractive indices, the light beam will be partially refracted at the boundary surface, and partially reflected. However, if the angle of incidence is greater (i.e. the ray is closer to being parallel to the boundary) than the critical angle (the angle of incidence at which light is refracted such that it travels along the boundary) then the light will stop crossing the boundary altogether and instead be totally reflected back internally. This can only occur where light travels from a medium with a higher refractive index to one with a lower refractive index. For example, it will occur when passing from glass to air, but not when passing from air to glass.

Each lens according to the present disclosure can be adapted to receive a single LED. The LED should be positioned adjacent to, or partially disposed within, recess 20 such that light from the LED is redirected from the exterior surfaces of lens portion 12. The present disclosure further provides for a luminaire system comprising a plurality of LEDs having a lens mounted over it. The lenses are configured to allow for the luminaire system to illuminate a desired light pattern. In a particular example, the luminaire system is a street lamp.

The lenses can be fabricated through injection molding of plastic pieces. Suitable injection-moldable plastics with a sufficiently high optical transmission include acrylic polymers such as polymethylmethacrylate (PPMA; $n_d$-1.49) and other thermoplastic polymers such as polystyrene ($n_d$-1.59), polycarbonate ($n_d$-1.59), and poly(styrene acrylonitrile) ($n_d$-1.57). Throughput of the molding process can be increased by using multi-cavity tooling where many lenses are formed simultaneously. The lens can be mounted over the LED to form a lighting fixture comprised of a printed circuit board, an LED mounted on the circuit board, and a lens mounted over the LED and on the circuit board. Manual or automatic assembly of the lighting fixture can be used. Automated robotic assembly systems can be preprogrammed allowing increased precision, efficiency, and repeatability. The lens can be manufactured to be within a highly precise tolerance range with respect to the LED. The tolerance range relates to the efficient focusing and light distribution of the lens in relation to the LED. For example, if the lens is outside a certain tolerance range distance from the LED, then much of the desired light reflection and/or refraction will be lost or redirected along an undesired pathway. To achieve the desired angles of reflection and/or refraction from the light of the LED through the lens material, the inner surface of the lens and outer surface of the lens are precisely configured. These parameters can be defined into the automated fabrication and assembly systems and with robotic programming, repeatability is improved. Lenses according to the present disclosure are capable of reaching efficiencies of up to about 92%. More generally, light patterns and their corresponding lenses suitably have efficiencies of at least about 70%, 80%, 85%, or 90% and/or up to about 85%, 95%, or 99%.

Figure 5:
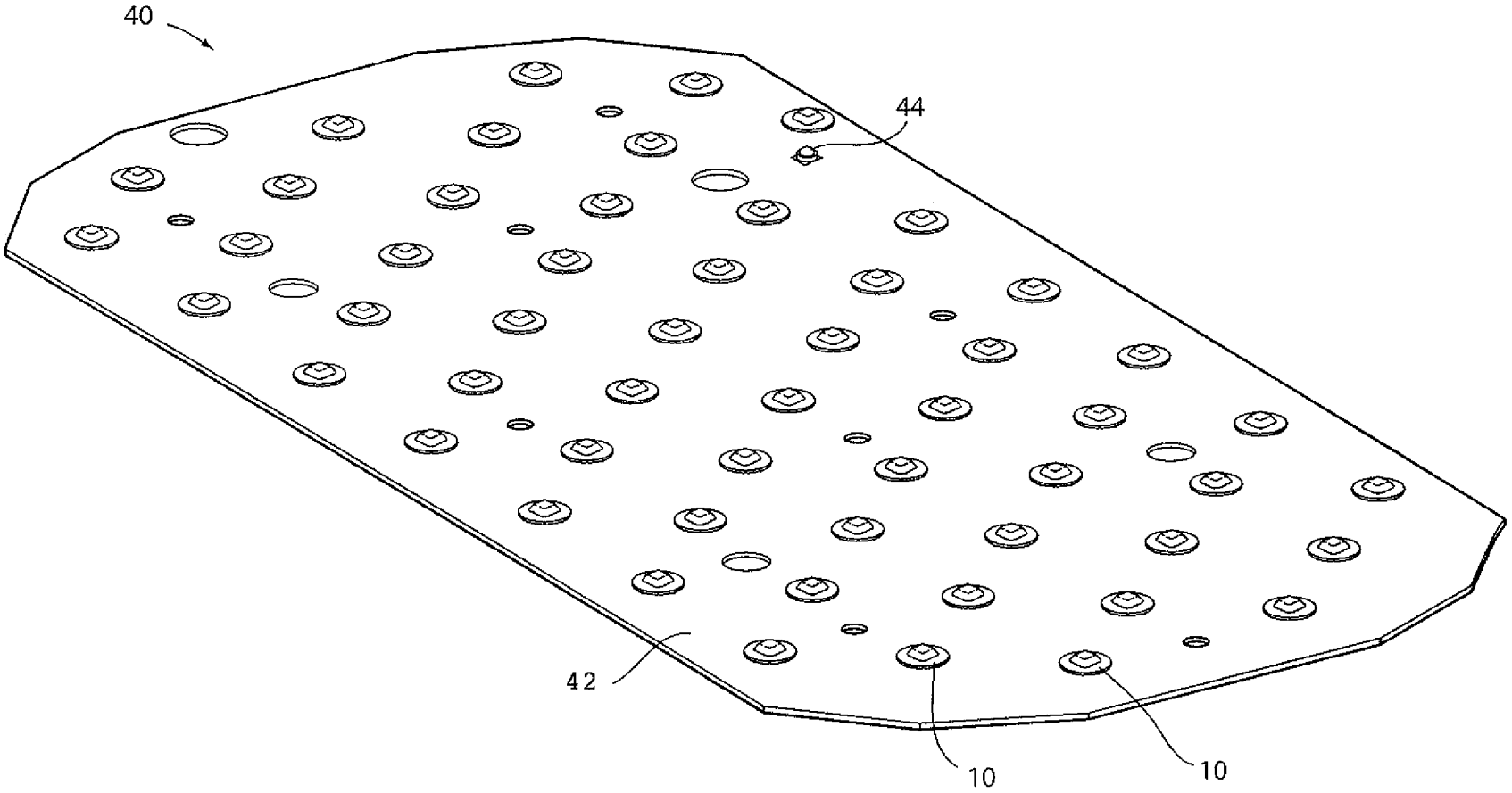
FIG. 5 is a perspective view of a light fixture employing a plurality of LEDs and lens bodies as shown in FIG. 1.

A lighting fixture 40 is shown in FIG. 5. Fixture 40 includes a substrate 42, such as a circuit board, on which are mounted a plurality of LEDs 44 arranged in an array. Illustrated circuit board 42 includes electrically conductive pathways, circuitry and an electrical power source connector to facilitate energizing of the LEDs and emission of light from the LEDs. A lens body 10 can be disposed over each of the plurality of LEDs.

When light travels from a medium with a higher refractive index to one with a lower refractive index, Snell's law seems to require in some cases (whenever the angle of incidence is large enough) that the sine of the angle of refraction be greater than one. This of course is impossible, and the light in such cases is completely reflected by the boundary, a phenomenon known as total internal reflection (TIR). The largest possible angle of incidence which still results in a refracted ray is called the critical angle; in this case the refracted ray travels along the boundary between the two media.

In an exemplary embodiment, LED 44 is positioned in the focal point of lens 10. This allows more accurate and precise light distribution through lens 10. The LED can be any color, but typically white. Some LEDs are operable to achieve 80 lumens per watt or more and more particularly 100 lumens per watt or more. Since LEDs are highly efficient, more of the energy is converted to light energy rather than heat. This allows the lenses to be placed in close proximity of the LED surface.

What is claimed is:

1. A lens member for directing light from an LED comprising;

a body formed of a light transmissive material, said body having a disc-shaped base portion and a bulbous-shaped light-directing lens portion extending upwardly from the disc-shaped base portion; and a recess extending upwardly from a lower generally planar surface of the disc-shaped base portion and into the bulbous-shaped light-directing lens portion, the recess continuously tapering from an elevation at or above the lower generally planar surface of the base to a flat, circular surface below a top surface of the bulbous-shaped, light-directing lens portion; and wherein the recess is defined by a plurality of adjacent curved facets.

2. The lens member of claim 1 wherein the recess at any elevation between the lower generally planar surface of the disc-shaped base and the flat, circular surface of the recess has a substantially circular horizontal cross-sectional shape.

3. A light fixture comprising a plurality of LEDs mounted on a substrate, the substrate including electrically conductive pathways, circuitry and an electrical power source connector to facilitate energizing of the LEDs and emission of light from the LEDs, and a plurality of lens members in accordance with claim 1, each lens member being positioned over a corresponding LED.

4. The light fixture of claim 3, wherein the LEDs and lens members are arranged in an array such that edges of a substantially square pattern of light emitted from each lens member are aligned in an edge-to-edge relationship to illuminate a selected surface evenly without substantial overlap, thereby providing an efficient illumination pattern with substantially uniform lighting intensity over the selected surface area.

5. A lens member for directing light from an LED comprising;

a body formed of a light transmissive material, said body having a disc-shaped base portion and a bulbous-shaped light-directing lens portion extending upwardly from the disc-shaped base portion;

the disc-shaped base portion having generally planar, parallel upper and lower surfaces;

a recess extending upwardly from the lower generally planar surface of the disc-shaped base portion and into the bulbous-shaped light-directing lens portion, the recess continuously tapering from an elevation at or above the lower generally planar surface of the base to a flat, circular surface centered below a top surface of the bulbous-shaped, light-directing lens portion;

the bulbous-shaped, light-directing lens portion at any elevation between the upper generally planar surface of the disc-shaped base portion and the top of the bulbous-shaped, light-directing lens portion defining a substantially square horizontal cross-sectional shape, the bulbous-shaped, light-directing lens portion continuously tapering from the upper generally planar surface of the disc-shaped base to the top of the bulbous-shaped, light-directing lens portion; whereby light emitted from an LED positioned adjacent the hollow recess will be projected from the lens member in a substantially square pattern; and wherein the recess is defined by a plurality of adjacent curved facets.

6. The lens member of claim 5, wherein the shapes of the light-directing lens portion and the recess are selected to achieve total internal reflection for light rays emitted from an LED positioned adjacent the hollow recess which would if not subjected to total internal reflection be projected from the lens member outside the desired substantially square pattern.

7. The lens member of claim 5, wherein the recess at any elevation between the lower generally planar surface of the disc-shaped base and the flat, circular surface of the recess has a substantially circular horizontal cross-sectional shape.

8. A light fixture comprising a plurality of LEDs mounted on a substrate, the substrate including electrically conductive pathways, circuitry and an electrical power source connector to facilitate energizing of the LEDs and emission of light from the LEDs, and a plurality of lens members in accordance with claim 5, each lens member being positioned over a corresponding LED.

9. The light fixture of claim 8, wherein the LEDs and lens members are arranged in an array such that edges of a substantially square pattern of light emitted from each lens member are aligned in an edge-to-edge relationship to illuminate a selected surface evenly without substantial overlap, thereby providing an efficient illumination pattern with substantially uniform lighting intensity over the selected surface area.

10. The lens member of claim 5, wherein the light transmissive material comprises a thermoplastic polymer.

11. The lens member of claim 10, wherein the thermoplastic polymer is selected from acrylic polymers, polystyrene, polycarbonates and polystyrene acrylonitrile).

12. The lens member of claim 10, wherein the thermoplastic polymer is polymethylmethacrylate.

13. A lens member for directing light from an LED comprising;

a body formed of a light transmissive material, said body having a disc-shaped base portion and a bulbous-shaped light-directing lens portion extending upwardly from the disc-shaped base portion;

the disc-shaped base portion having generally planar, parallel upper and lower surfaces;

a recess extending upwardly from the lower generally planar surface of the disc-shaped base portion and into the bulbous-shaped light-directing lens portion, the recess continuously tapering from an elevation at or above the lower generally planar surface of the base to a flat circular surface centered below a top surface of the bulbous-shaped light-directing lens portion;

the bulbous-shaped, light-directing lens portion at any elevation between the upper generally planar surface of the disc-shaped base portion and the top of the bulbous-shaped, light-directing lens portion defining a substantially square horizontal cross-sectional shape, the bulbous-shaped, light-directing lens portion continuously tapering from the upper generally planar surface of the disc-shaped base to the top of the bulbous-shaped, light-directing lens portion, whereby light emitted from an LED positioned adjacent the hollow recess will be projected from the lens member in a substantially square pattern;

wherein the light transmissive material comprises a thermoplastic polymer; and a plurality of nubs projecting downwardly from the generally planar lower surface of the base portion.

14. The lens member of claim 13, wherein the nubs are angularly disposed apart from each other adjacent an edge of the base portion.

15. The lens member of claim 10, wherein the recess comprises a cylindrical section extending upwardly from the generally planar lower surface, and a truncated spherical cap disposed above the cylindrical section.

* * * * *

UNITED STATES PATENT AND TRADEMARK OFFICE

CERTIFICATE OF CORRECTION

PATENT NO. : 9,010,963 B2
APPLICATION NO. : 13/893412
DATED : April 21, 2015
INVENTOR(S) : Derek S. Mallory and Brian C. Wells It is certified that error appears in the above-identified patent and that said Letters Patent is hereby corrected as shown below:

In the Claims

Column 6, line 23 (Claim 11) "polycarbonates and polystyrene acrylonitrile)."
Should be - "polycarbonates and poly(styrene acrylonitrile)."

Signed and Sealed this
Fourth Day of August, 2015

Michelle K. Lee

Michelle K. Lee
*Director of the United States Patent and Trademark Office*